US010981382B2

(12) United States Patent
Yoshida

(10) Patent No.: US 10,981,382 B2
(45) Date of Patent: Apr. 20, 2021

(54) LIQUID DISCHARGE HEAD, LIQUID DISCHARGE DEVICE, AND LIQUID DISCHARGE APPARATUS

(71) Applicant: Takahiro Yoshida, Kanagawa (JP)

(72) Inventor: Takahiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/601,929

(22) Filed: Oct. 15, 2019

(65) Prior Publication Data

US 2020/0147961 A1 May 14, 2020

(30) Foreign Application Priority Data

Nov. 13, 2018 (JP) ..... JP2018-212928

(51) Int. Cl.
*B41J 2/14* (2006.01)
*B41J 2/18* (2006.01)

(52) U.S. Cl.
CPC ..... *B41J 2/14274* (2013.01); *B41J 2/14201* (2013.01); *B41J 2/18* (2013.01); *B41J 2202/11* (2013.01); *B41J 2202/12* (2013.01); *B41J 2202/20* (2013.01)

(58) Field of Classification Search
CPC ..... B41J 2/14274; B41J 2/14201; B41J 2202/20; B41J 2202/11; B41J 2/18; B41J 2202/12
See application file for complete search history.

(56) References Cited

U.S. PATENT DOCUMENTS

| | | | | |
|---|---|---|---|---|
| 9,815,284 | B2 * | 11/2017 | Takeuchi | B41J 2/14274 |
| 2015/0246536 | A1 | 9/2015 | Yoshida | |
| 2016/0185113 | A1 | 6/2016 | Yoshida et al. | |
| 2016/0297193 | A1 | 10/2016 | Yoshida | |
| 2017/0087865 | A1 | 3/2017 | Yoshida et al. | |
| 2017/0096015 | A1 | 4/2017 | Odaka et al. | |
| 2017/0120602 | A1 | 5/2017 | Nakai et al. | |
| 2017/0157924 | A1 | 6/2017 | Otome et al. | |
| 2017/0239949 | A1 | 8/2017 | Yoshida | |
| 2017/0253062 | A1 | 9/2017 | Murakami et al. | |
| 2017/0297333 | A1 | 10/2017 | Kohda et al. | |
| 2018/0194135 | A1 | 7/2018 | Iwama et al. | |
| 2018/0257374 | A1 | 9/2018 | Yoshida et al. | |
| 2018/0272709 | A1 | 9/2018 | Iwata et al. | |

(Continued)

FOREIGN PATENT DOCUMENTS

| | | |
|---|---|---|
| JP | 2017-077643 | 4/2017 |
| JP | 2017-144659 | 8/2017 |

*Primary Examiner* — Geoffrey S Mruk
(74) *Attorney, Agent, or Firm* — Oblon, McClelland, Maier & Neustadt, L.L.P.

(57) ABSTRACT

A liquid discharge head includes a plurality of nozzles from which a liquid is discharged, the plurality of nozzles arrayed in one direction, a plurality of pressure chambers communicating with the plurality of nozzles, respectively, the plurality of pressure chambers arrayed in the one direction, a common supply channel communicating with each of the plurality of pressure chambers, a common collection channel communicating with each of the plurality of pressure chambers, and a damper disposed outside an array of the plurality of pressure chambers in the one direction, and configured to form an inner surface of at least one of the common supply channel and the common collection channel.

16 Claims, 16 Drawing Sheets

(56) References Cited

U.S. PATENT DOCUMENTS

| | | | |
|---|---|---|---|
| 2018/0272730 | A1 | 9/2018 | Odaka et al. |
| 2018/0272739 | A1 | 9/2018 | Sawase et al. |
| 2018/0272740 | A1 | 9/2018 | Otome et al. |
| 2018/0272743 | A1 | 9/2018 | Nakai et al. |
| 2019/0084313 | A1 | 3/2019 | Kohda et al. |
| 2019/0240978 | A1 | 8/2019 | Kawahara et al. |
| 2019/0263119 | A1 | 8/2019 | Odaka et al. |
| 2019/0283414 | A1 | 9/2019 | Yoshida |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-212928, filed on Nov. 13, 2018, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head, there is a flow-through head (circulation head) that includes a plurality of supply channels connected to a plurality of pressure chambers (individual chambers), respectively, and a plurality of collection channels connected to the plurality of pressure chambers (individual chambers), respectively. The plurality of pressure chambers (individual chambers) is connected to a plurality of nozzles, respectively. Hereinafter, the "liquid discharge head" is also simply referred to as the "head". The flow-through head (circulation head) further includes a supply port connected to the plurality of supply channels and a collection port connected to the plurality of collection channels. The circulation head may circulate only a common channel.

SUMMARY

In an aspect of this disclosure, a liquid discharge head includes a plurality of nozzles from which a liquid is discharged, the plurality of nozzles arrayed in one direction, a plurality of pressure chambers communicating with the plurality of nozzles, respectively, the plurality of pressure chambers arrayed in the one direction, a common supply channel communicating with each of the plurality of pressure chambers, a common collection channel communicating with each of the plurality of pressure chambers, and a damper disposed outside an array of the plurality of pressure chambers in the one direction, and configured to form an inner surface of at least one of the common supply channel and the common collection channel.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
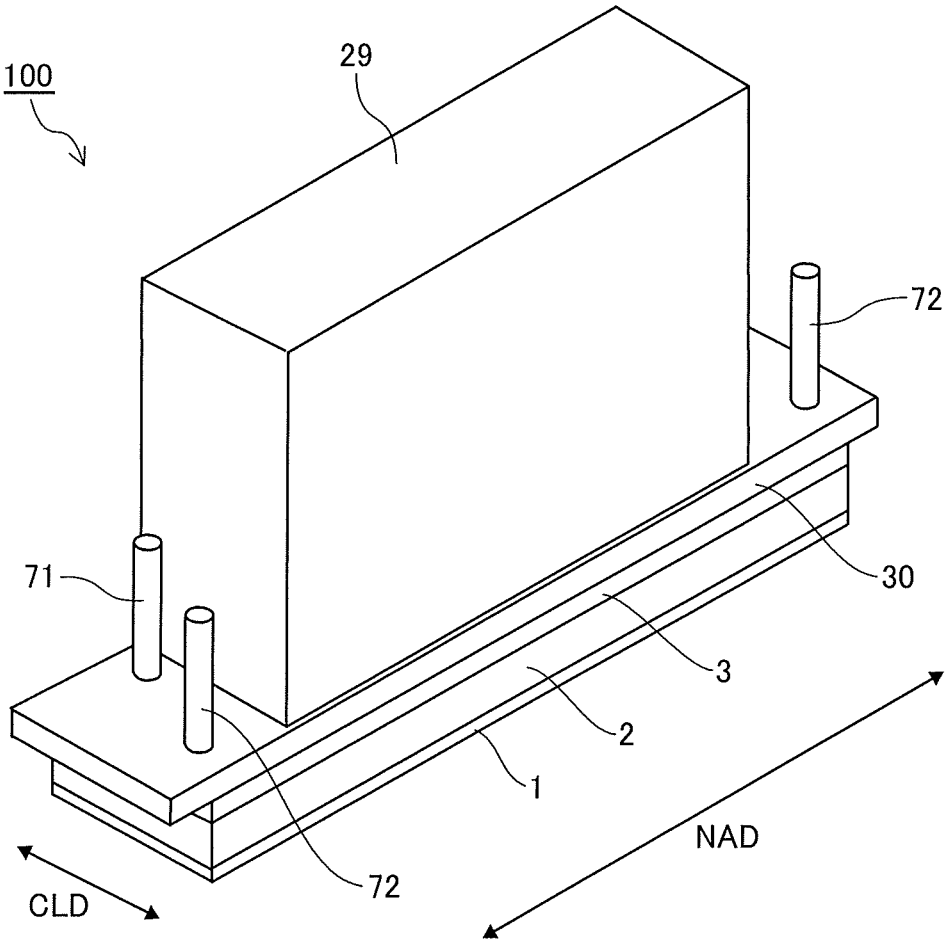
FIG. 1 is an outer perspective view of the liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings. A first embodiment of the present disclosure is described with reference to FIGS. 1 to 3.

FIG. 1 is an outer perspective view of a liquid discharge head 100 according to the first embodiment of the present disclosure.

Figure 2:
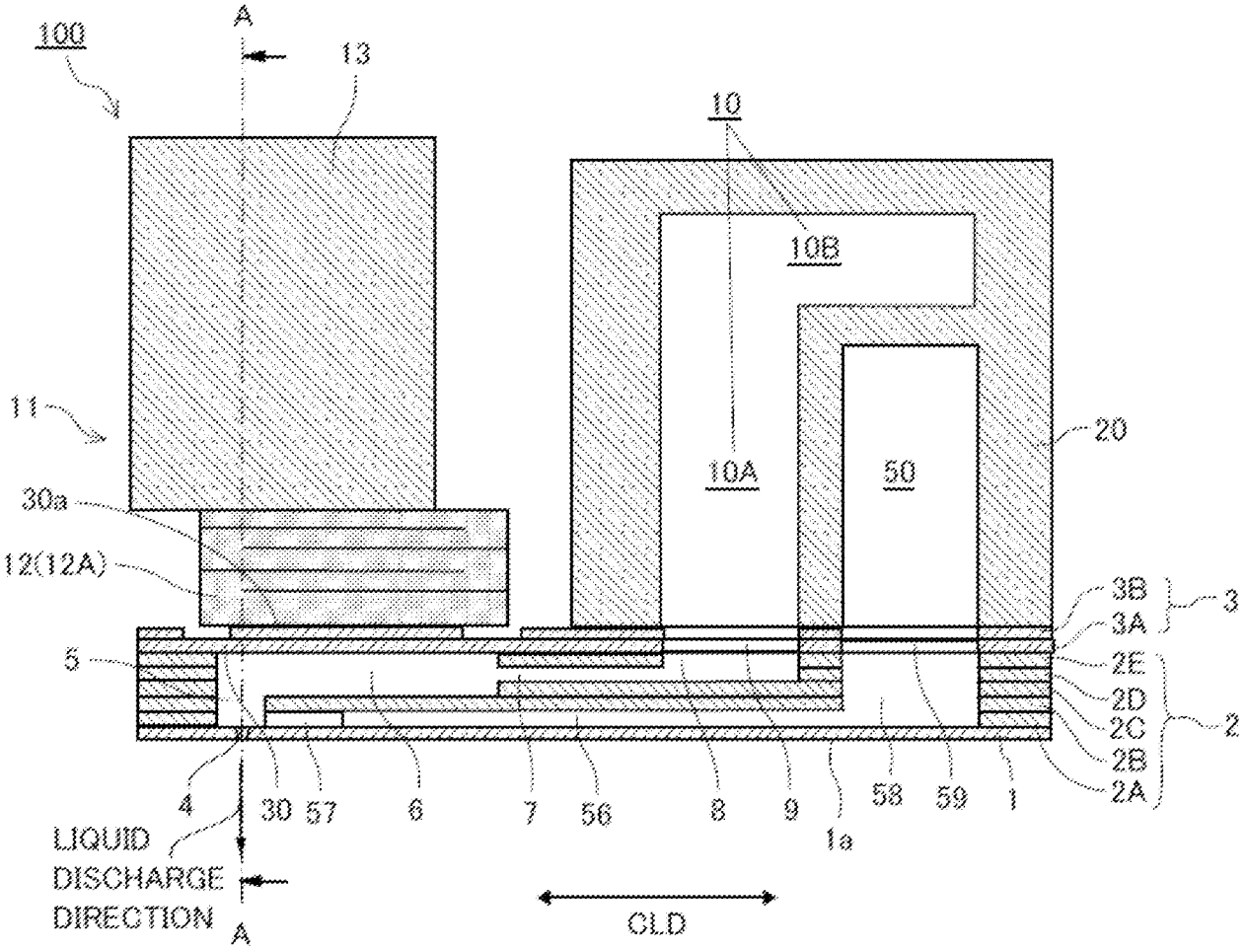
FIG. 2 is a cross-sectional side view of the liquid discharge head of FIG. 1 in a chamber length direction perpendicular to a nozzle array direction in which nozzles are arrayed in row.

FIG. 2 is a cross-sectional side view of the liquid discharge head 100 in a longitudinal direction of the pressure chamber 6 (individual chamber) that is a direction perpendicular to a nozzle array direction in which nozzles 4 are arrayed in row. The nozzle array direction is indicated by arrow "NAD" in FIG. 3.

The "longitudinal direction of the pressure chamber 6" is also referred to as "chamber length direction" indicated by arrow "CLD" in FIG. 2.

Figure 3:
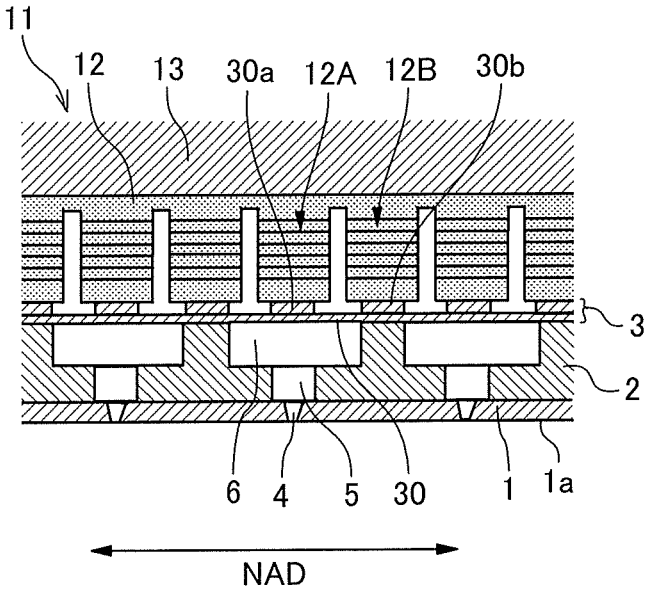
FIG. 3 is a cross-sectional side view of the liquid discharge head of FIG. 2 along line A-A in a direction along the nozzle array direction (chamber length direction)

FIG. 3 is a cross-sectional side view of the liquid discharge head 100 of FIG. 2 along line A-A in a direction along the nozzle array direction NAD (a transverse direction of the pressure chamber 6).

Hereinafter, the "liquid discharge head" is simply referred to as the "head".

The head 100 according to the first embodiment of the present disclosure includes a nozzle plate 1, a channel plate 2, and a diaphragm 3 that are laminated one on another and bonded to each other. The diaphragm 3 serves as a wall or a floor of channels in the head 100 and forms an inner surface of the channels in the head 100. The head 100 further includes a piezoelectric actuator 11 that deforms the diaphragm 3, a common channel member 20, and a cover 29.

The nozzle plate 1 includes a plurality of nozzles 4 to discharge a liquid.

The channel plate 2 is a channel member that includes pressure chambers 6 (individual chambers), supply-side fluid restrictors 7, and supply-side inlets 8. The pressure chambers 6 communicate with the nozzles 4, respectively. The supply-side fluid restrictors 7 communicate with the pressure chambers 6 (individual chambers), respectively. The supply-side inlets 8 communicate with the supply-side fluid restrictors 7, respectively. The supply-side inlets 8 communicate with a common supply channel 10 through a supply-side opening 9 formed in the diaphragm 3. The common supply channel 10 is formed by the common channel member 20.

The channel plate 2 has a layer structure includes a plurality of plates 2A to 2E (thin-layer members) stacked (laminated) and bonded one on another from the side of the nozzle plate 1. Note that, in FIG. 2, the channel plate 2 is illustrated in a simplified manner as one member.

The diaphragm 3 is a plate that forms a wall (floor) of the pressure chamber 6 of the channel plate 2. The diaphragm 3 has a two-layer structure (can be three or more layers), and is formed of a first layer that forms a thin portion and a second layer that forms a thick portion from the channel plate 2 side. The first layer of the diaphragm 3 includes a deformable vibration portion 30 positioned corresponding to the pressure chambers 6 (individual chamber).

The piezoelectric actuators 11 includes electromechanical transducer elements as driving devices (actuator devices or pressure generators) to deform the vibration portions 30 of the diaphragm 3. The piezoelectric actuators 11 are disposed at a first side of the diaphragm 3 opposite a second side of the diaphragm 3 facing the pressure chambers 6 (individual chambers).

The piezoelectric actuator 11 includes piezoelectric members 12 bonded on a base 13. The piezoelectric members 12 are groove-processed by half-cut dicing so that each piezoelectric member 12 includes a desired number of pillar-shaped piezoelectric elements 12A and 12B that are arranged in certain intervals to have a comb shape.

In the first embodiment, the piezoelectric elements 12A of the piezoelectric member 12 are piezoelectric elements to be driven by application of drive waveforms and the piezoelectric elements 12B are supports to which no drive waveform is applied. In some embodiments, all of the piezoelectric elements 12A and the piezoelectric elements 12B may be piezoelectric elements to be driven by application of drive waveforms.

The piezoelectric element 12A is joined to the convex portion 30*a*, which is an island-shaped thick portion on the vibration portion 30 of the diaphragm 3. The piezoelectric element 12B is bonded to the convex portion 30*b*, which is a thick portion of the diaphragm 3.

The piezoelectric member 12 includes piezoelectric layers and internal electrodes alternately laminated on each other. Each internal electrode is pulled out to an end surface of the piezoelectric member 12 to form an external electrode. The external electrode is connected to a flexible wiring member.

The channel plate 2 includes collection-side fluid restrictors 57, collection-side individual channels 56, and collection-side outlets 58. The collection-side fluid restrictors 57, the collection-side individual channels 56, and the collection-side outlets 58 are formed along a surface direction of the channel plate 2, and communicate with the pressure chambers 6 (individual chambers), respectively. The collection-side outlets 58 communicate with the common collection channel 50 formed by the common channel member 20 through the collection-side opening 59 formed in the diaphragm 3.

"The common collection channel 50" is also referred to as "the common circulation channel 50" or "the common recovery channel 50".

The plates 2A to 2C and the nozzle plate 1 form the collection-side fluid restrictors 57, the collection-side individual channels 56, and the collection-side outlets 58 as illustrated in FIG. 2.

The common channel member 20 defines a common supply channel 10 and a common collection channel 50. The common channel member 20 further includes a supply port 71 to supply the liquid from an external circulation path to the common supply channel 10 and a collection port 72 to collect liquid to the external circulation path.

The pressure chambers 6 communicate with the nozzles 4 via nozzle communication channels 5, respectively. The nozzle communication channels 5 are channels to communicate with the nozzles 4 and the pressure chambers 6, respectively.

The common supply channel 10 includes a channel portion 10A arranged side-by-side with the common collection channel 50 in a direction perpendicular to the nozzle array direction NAD (in the chamber length direction CLD). Further, the common supply channel 10 includes a channel portion 10B arranged above the common collection channel 50. The channel portion 10B is not arranged side-by-side with the common collection channel 50 in the direction perpendicular to the nozzle array direction NAD (along the chamber length direction CLD).

In the head 100 thus configured, for example, when a voltage lower than a reference potential is applied to the piezoelectric element 12A, the piezoelectric element 12A contracts. Accordingly, the vibration portion 30 of the diaphragm 3 moves downward in FIG. 3 and the volume of the pressure chamber 6 increases, thus causing liquid to flow into the pressure chamber 6.

When the voltage applied to the piezoelectric element 12A is raised, the piezoelectric element 12A expands in a direction of lamination of the piezoelectric element 12A. The vibration portion 30 of the diaphragm 3 deforms in a direction toward the nozzle 4 and contracts the volume of the pressure chambers 6. As a result, the liquid in the pressure chambers 6 is squeezed out of the nozzle 4.

When the voltage applied to the piezoelectric element 12A is returned to the reference potential, the vibration portion 30 of the diaphragm 3 is returned to the initial position. Accordingly, the pressure chamber 6 expands to generate a negative pressure, thus replenishing liquid from the common supply channel 10 into the pressure chamber 6. After the vibration of a meniscus surface of the nozzle 4 decays to a stable state, the head 100 shifts to an operation for the next liquid discharge.

Further, the liquid not discharged from the nozzle 4 passes through the nozzle 4 and is discharged to the common collection channel 50 through the collection-side fluid restrictor 57, the collection-side individual channel 56, the collection-side outlet 58, and the collection-side opening 59. Then, the liquid is supplied from the common collection channel 50 to the common supply channel 10 again through an external circulation passage. Even when the liquid is not discharged from the nozzle 4, the liquid flows from the common supply channel 10 to the common collection channel 50 and is again supplied to the common supply channel 10 through the external circulation passage.

Note that the driving method of the head 100 is not limited to the above-described example (pull-push discharge). For example, pull discharge or push discharge may be performed in accordance with the way to apply a drive waveform.

In the head 100, the common supply channel 10 includes a channel portion 10A arranged side-by-side with the common collection channel 50 in a direction perpendicular to the nozzle array direction NAD (along the chamber length direction CLD). Further, the channel portion 10B, which is a part of the common supply channel 10, is arranged above the common collection channel 50 and is not aligned with the common collection channel 50 in the direction perpendicular to the nozzle array direction NAD (in the chamber length direction CLD).

Figure 4:
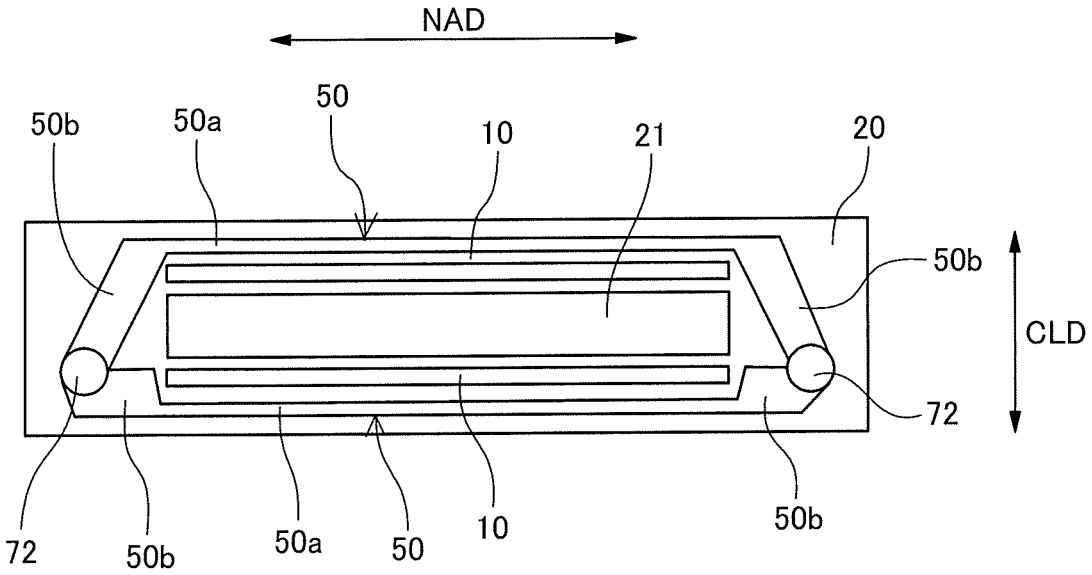
FIG. 4 is a plan view of a common channel member viewed from a diaphragm side.
Figure 5:
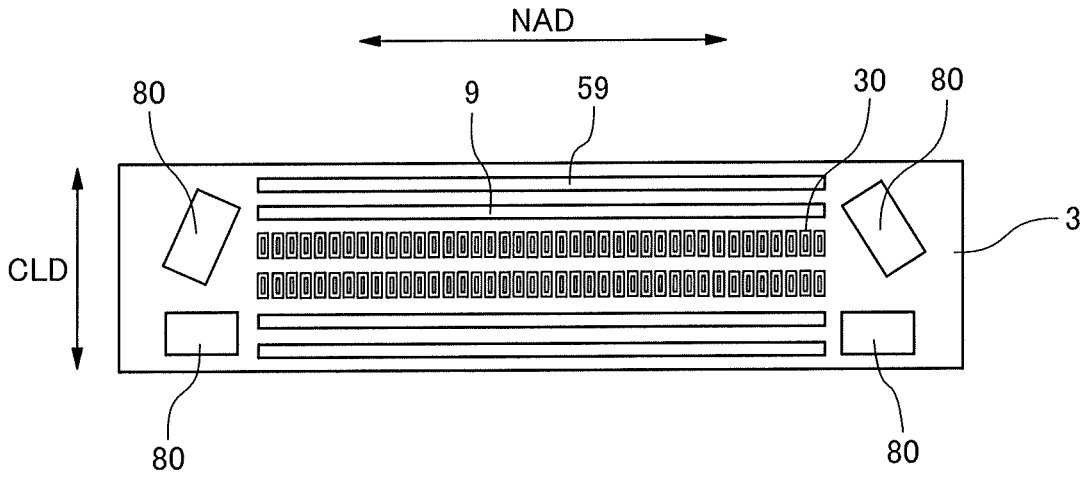
FIG. 5 is a plan view of the diaphragm viewed from the common channel member side.
Figure 6:
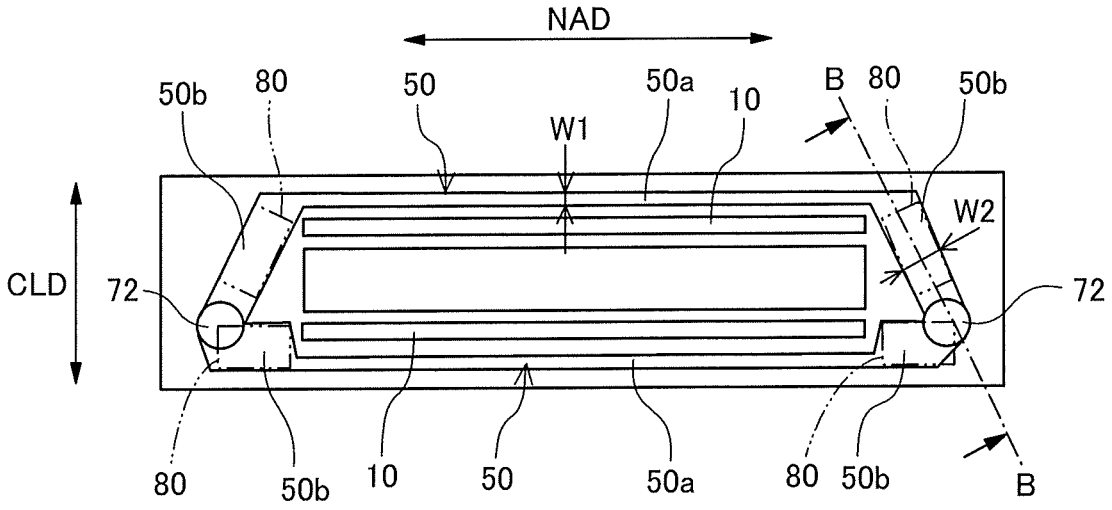
FIG. 6 is a plan view of the common channel member to which the diaphragm is bonded.
Figure 7:
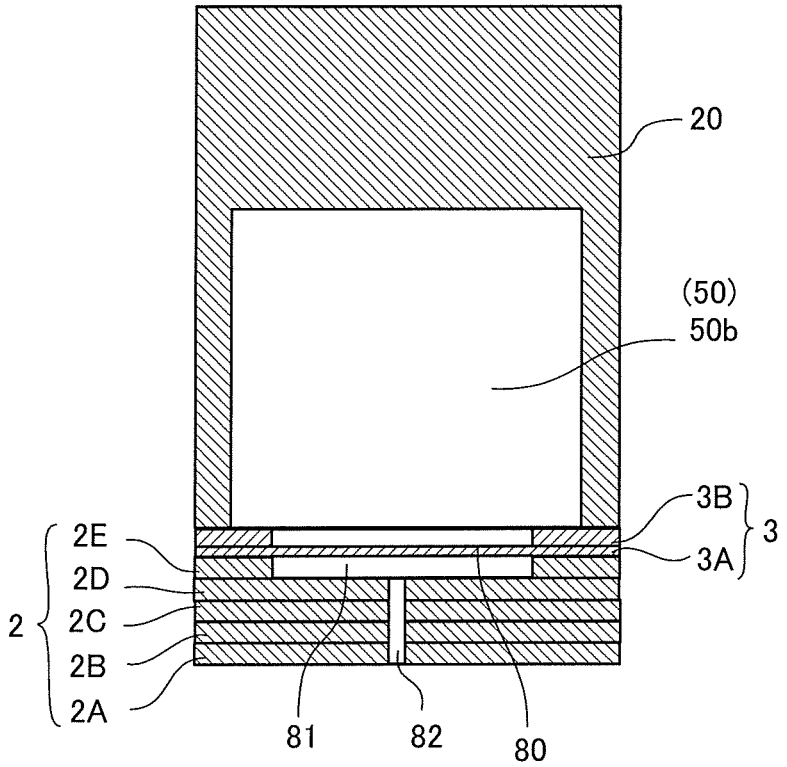
FIG. 7 is a cross-sectional side view of the head along a line B-B of FIG. 6.

FIGS. 4 to 7 illustrates a vibration damping structure (damper structure) of the common channel in the present disclosure. FIG. 4 is a plan view of the common channel member 20 viewed from the diaphragm 3 side (bottom view of the common channel member 20). FIG. 5 is a plan view of the diaphragm 3 viewed from the common channel member 20 side (top view of the diaphragm 3). FIG. 6 is a plan view of common channel member 20 to which the diaphragm 3 is bonded. FIG. 6 illustrates a relationship between a damper region and the common collection channel 50. FIG. 7 is a cross-sectional side view of the head 100 along a line B-B of FIG. 6.

The common channel member 20 includes a common supply channel 10, a common collection channel 50, and an opening 21 for the piezoelectric actuator 11.

The common collection channel 50 includes a channel portion 50*a* and 50*b*. The channel portion 50*a* communicates with the pressure chambers 6 through the collection-side opening 59 of the diaphragm 3. The channel portion 50*a* is arranged along (parallel to) the nozzle array direction NDA.

The channel portion 50*b* is arranged outside the plurality of pressure chambers 6 arrayed in the nozzle array direction NDA and communicates with the collection port 72. In FIG. 4, the common channel member 20 includes the channel portion 50*b* at each ends of the common collection channel 50 in the nozzle array direction NAD, and each ends of the channel portion 50*a* is connected to the channel portions 50*b* disposed at each ends of the common collection channel 50 in the nozzle array direction NAD.

The common channel member 20 includes a deformable plate (displaceable wall) serving as a damper 80 in a part of the wall (floor) of the channel portion 50*b* disposed outside the array of the plurality of pressure chambers 6 in the nozzle array direction NAD (in a direction of the array of the pressure chambers 6 and the vibration portions 30, or in a longitudinal direction of the common collection channel 50).

Thus, the common collection channel 50 includes the damper 80 that is a deformable plate (displaceable wall) disposed outside an array of the plurality of pressure chambers 6 in the nozzle array direction NAD.

The diaphragm 3 forms a part of an inner surface (wall or floor) of the common collection channel 50. The diaphragm 3 includes a thin portion including only a first layer 3A and a thick portion including both of the first layer 3A and a second layer 3B. The damper 80 is composed of the first layer 3A (thin wall portion).

Thus, the damper 80 disposed outside an array of the plurality of pressure chambers 8 in the one direction (chamber length direction CLD). The damper 80 forms an inner surface of at least one of the common supply channel 10 and the common collection channel 50. The diaphragm 3 (plate) forms a portion of the inner surface of the common supply channel and the common collection channel. The diaphragm 3 (plate) includes a first portion (first layer 3A) and a second portion (first layer 3A and second layer 3B) having a higher rigidity than the first portion (first layer 3A), and the first portion (first layer 3A) forms the damper 80.

Thus, the head 100 can reduce a size of the head 100 in a lamination direction of the channel plate 2 and the diaphragm 3 and also has a damping function in the common collection channel 50.

Further, the damper 80 of the head 100 can effectively damp a pressure change with a small area since the wall (diaphragm 3) includes a thick portion and a thin portion that forms the damper 80 serving as a deformable plate (displaceable wall).

Thus, the head 100 includes the wall (diaphragm 3) formed of members (plates) having different rigidity such as the thick portion and the thin portion, and the damper 80 serving as the deformable plate (displaceable wall) is formed of a member (plate) having low rigidity such as the thin portion. Thus, the damper 80 of the head 100 can effectively damp the pressure change with a small area.

Thus, the head 100 includes a plate (diaphragm 3) configured to seal a portion of a surface of the common supply channel 10 and the common collection channel 50. The plate (diaphragm 3) includes a first portion and a second portion having a lower rigidity than the first portion, and the second portion forms the damper 80. The first portion is a thin portion, the second portion is a thick portion having a thickness thicker than the thin portion, and the thin portion forms the damper 80.

In FIG. 6, the channel width W2 of the channel portion 50*b* is wider than the channel width W1 of the channel portion 50*a* of the common collection channel 50 (W2>W1).

Thus, the channel width W2 of a portion of the common collection channel 50 that faces the damper 80 is wider than a width of another portion of the common collection channel 50 connected with the plurality of pressure chambers 6.

Further, each of the channel portions 50*b* is inclined with respect to the nozzle array direction NAD with an angle θ. The head 100 including the damper 80 in the channel portion 50*b* having a channel width W2 wider than the channel width W1 of the channel portion 50*a*. Thus, the head 100 can effectively damp the pressure change in the common collection channel 50.

As illustrated in FIG. 7, the head 100 includes a gas chamber 81 formed opposite to the common collection channel 50 with damper 80 interposed between the gas chamber 81 and the common collection channel 50. Plates 2D, 2E, and the first layer 3A of the diaphragm 3 forms the gas chamber 81 among the plates 2A to 2E forming a plurality of layers constituting the channel plate 2 as channel member. The plate 2E contacts the first layer 3A of the diaphragm 3.

Further, the head 100 includes an air communication channel 82 that connects the gas chamber 81 with the atmosphere. The air communication channel 82 penetrates through the plates 2A to 2D, which are layers different from the plate 2E of the channel plate 2 as the channel member. Thus, the damper 80 can stably deforms (displaces).

Figure 8:
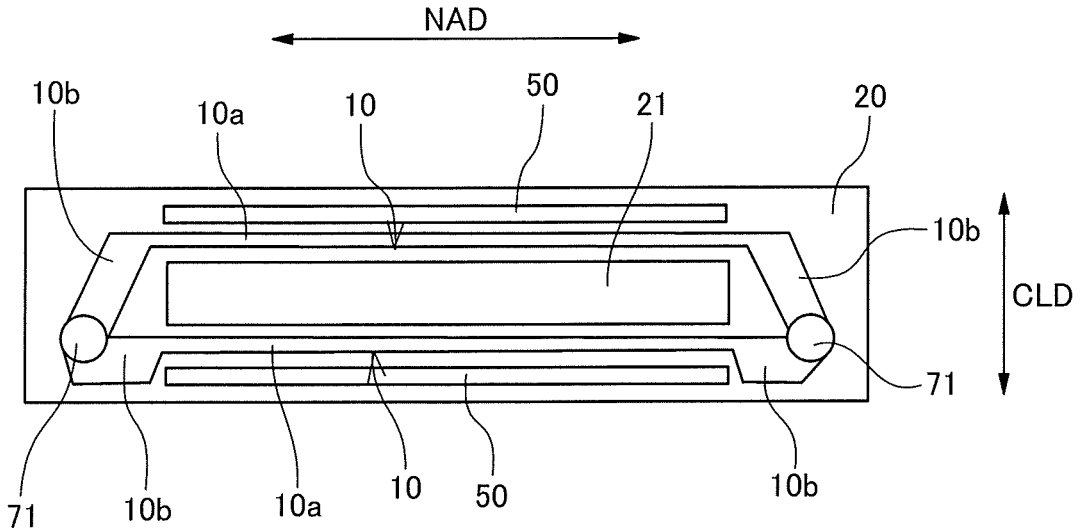
FIG. 8 is a plan view of the common channel member according to a second embodiment viewed from the diaphragm side.
Figure 9:
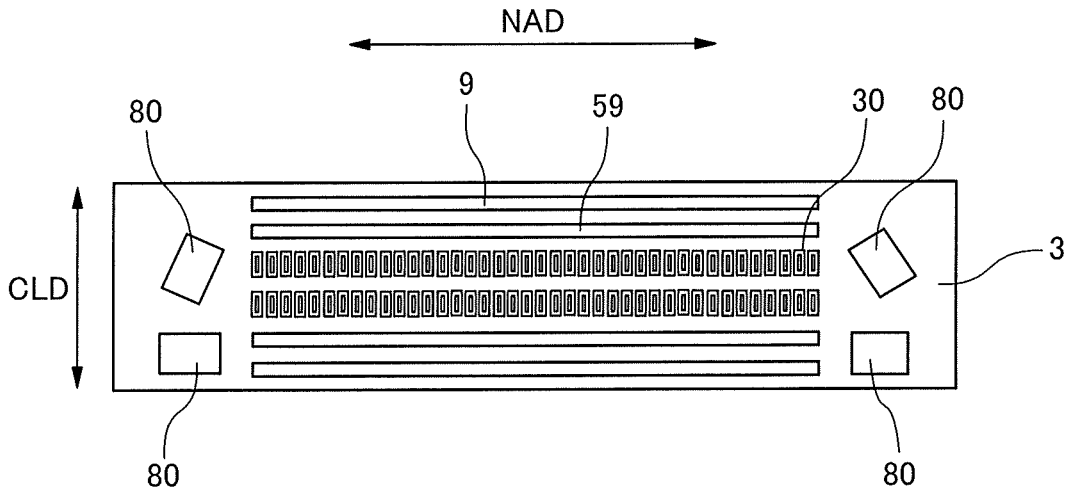
FIG. 9 is a plan view of the diaphragm viewed from the common channel member side.
Figure 10:
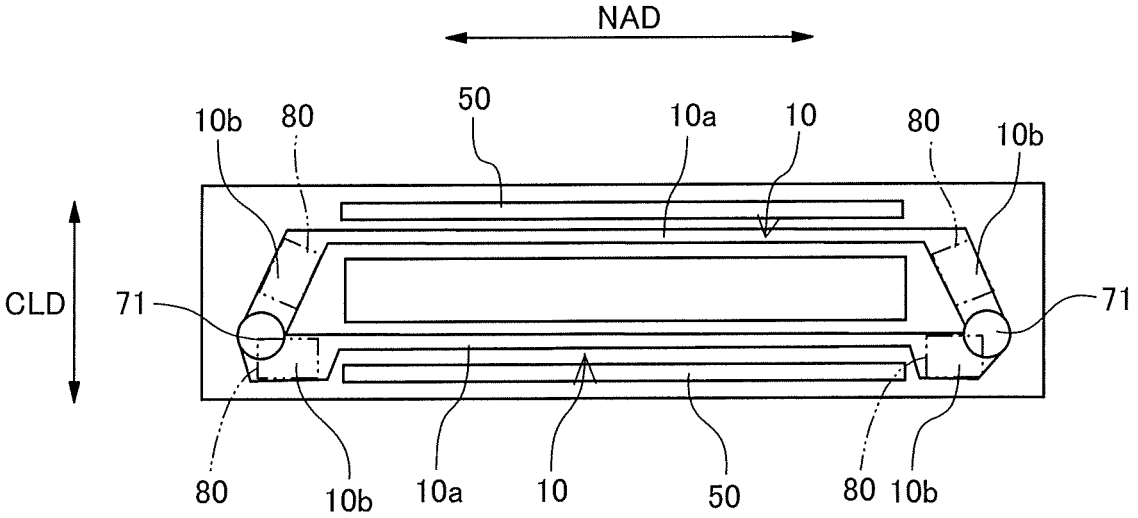
FIG. 10 is a plan view of the common channel member to which the diaphragm is bonded to illustrate a relation between a damper region and a common supply channel.

FIGS. 8 to 10 illustrates a second embodiment of the head 100 according to the present disclosure.

FIG. 8 is a plan view of the common channel member 20 viewed from the diaphragm 3 side (bottom view of the common channel member 20). FIG. 8 illustrates a structure of damping vibration (damper structure) of the common channel.

FIG. 9 is a plan view of the diaphragm 3 viewed from the common channel member 20 side (top view of the diaphragm 3).

FIG. 10 is a plan view of common channel member 20 to which the diaphragm 3 is bonded. FIG. 10 illustrates a relationship between a damper region and the common collection channel 50.

The common supply channel 10 includes a channel portion 10*a* and 10*b*. The channel portion 10*a* communicates with the pressure chambers 6 through the supply-side opening 9 of the diaphragm 3. The channel portion 10*a* is arranged along (parallel to) the nozzle array direction NDA.

The channel portion 50*b* is arranged outside the plurality of pressure chambers 6 arrayed in the nozzle array direction NDA and communicates with the supply port 71.

In FIG. 8, the common supply channel 10 includes the channel portion 10*b* at each ends of the common supply channel 10 in the nozzle array direction NAD, and each ends of the channel portion 10*a* is connected to the channel portions 10*b* disposed at each ends of the common supply channel 10 in the nozzle array direction NAD.

A channel width of the channel portion 10*b* of the common supply channel 10 is wider than a channel width of the channel portion 10*a*. Thus, the channel width of a portion of the common supply channel 10 that faces the damper 80 is wider than a width of another portion of the common supply channel 10 connected with the plurality of pressure chambers 6.

The common channel member 20 includes a deformable plate (displaceable wall) serving as a damper 80 that forms an inner surface of a portion of the wall (floor) of the channel portion 10*b* disposed outside the array of the plurality of pressure chambers 6 in the nozzle array direction NAD (in a direction of the array of the pressure chambers 6 and the vibration portions 30, or in a longitudinal direction of the common supply channel 10).

Thus, the common supply channel 10 includes the damper 80 that is a deformable plate (displaceable wall) disposed outside an array of the plurality of pressure chambers 6 in the nozzle array direction NAD.

Thus, the head 100 can reduce a size of the head 100 in a lamination direction of the channel plate 2 and the diaphragm 3 and also has a damping function in the common supply channel 10.

The head 100 may include the damper 80 in both of the common supply channel 10 and the common collection channel 50 arranged outside the array of a plurality of pressure chambers 6 although a length of the head 100 in the nozzle array direction NAD may become longer than the first and second embodiments as described above.

Figure 11:
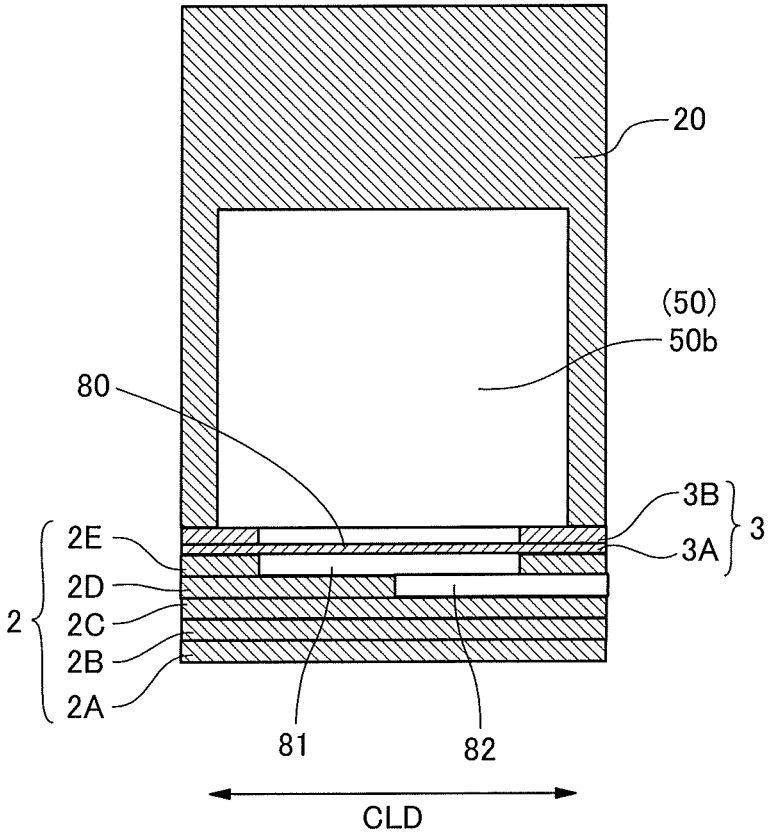
FIG. 11 is a cross-sectional side view of the head in the chamber length direction perpendicular to the nozzle array direction according to the third embodiment of the present disclosure.
Figure 12A:
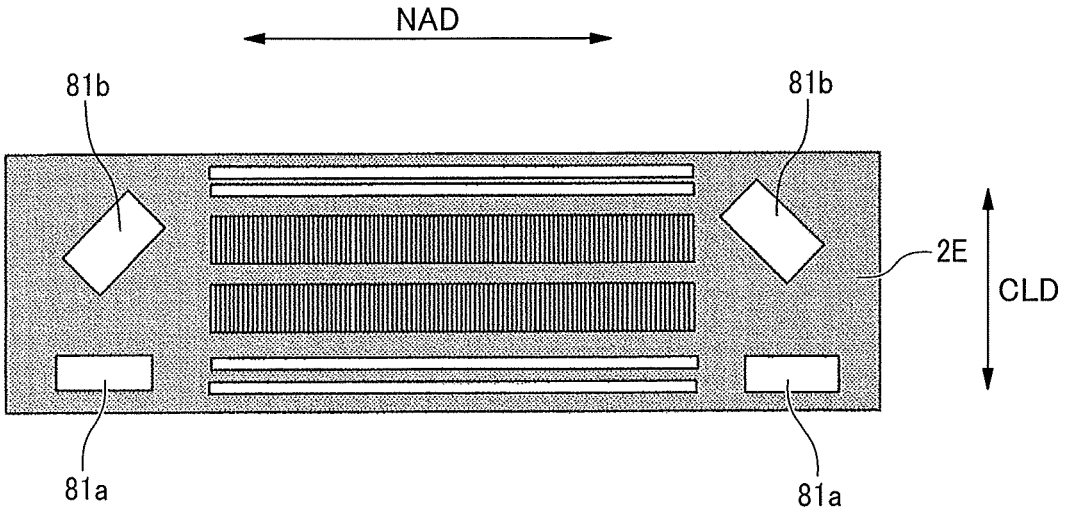
FIGS. 12A and 12B are plan views of plates constituting the channel plate of the head according to the third embodiment.
Figure 12B:
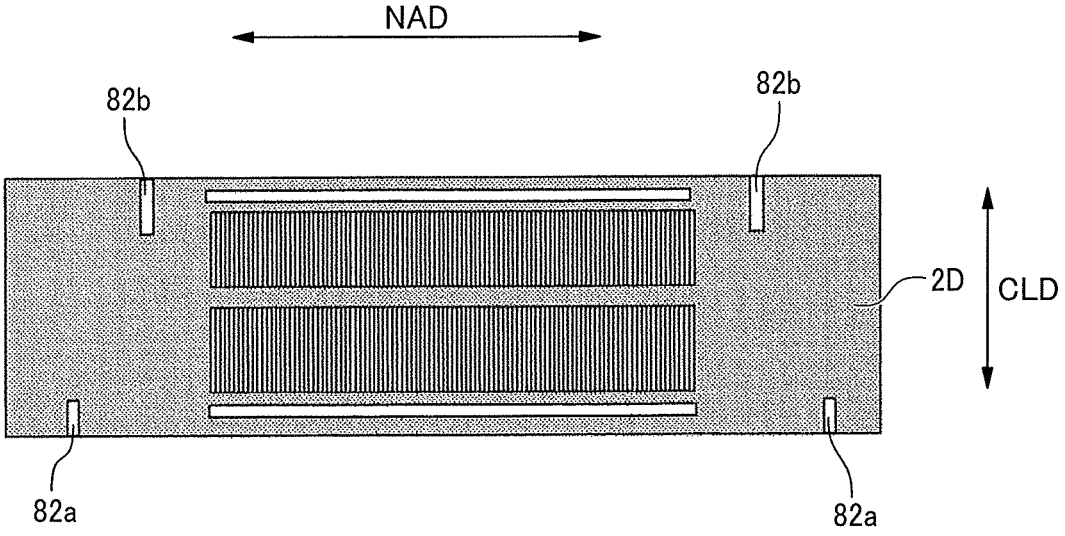

A third embodiment of the present disclosure is described with reference to FIG. 11 and FIGS. 12A and 12B. FIG. 11 is a cross-sectional side view of the head 100 in the chamber length direction CLD perpendicular to the nozzle array direction NAD. FIGS. 12A and 12B are plan views of plates 2D and 2E constituting the channel plate 2 of the head 100 according to the third embodiment.

The head 100 according to the third embodiment includes the gas chamber 81 in the channel plate 2 as a channel member and an air communication channel 82 opens to each ends of the channel plate 2 in a chamber length direction CLD (perpendicular to the nozzle array direction NAD) along a surface of the channel plate 2.

Specifically, the gas chamber 81 of the head 100 includes through holes 81*a* and 81*b* in a plate 2E that contacts the diaphragm 3. The air communication channel 82 includes a through groove 82*a* communicating with the through hole 81*a* and opening at one ends (lower end in FIG. 12B) in the chamber length direction CLD of the channel plate 2 and a through groove 82*b* communicating with the through hole 81*b* and opening at another end (upper end in FIG. 12B) in the chamber length direction CLD in the plate 2D of the channel plate 2.

Thus, the head 100 includes the through holes 81*a* and 81*b* and the through grooves 82*a* and 82*b* communicating with the air communication channel 82 and opening at each ends of the channel plate 2 (plates 2D and 2E). Thus, the head 100 can prevent the liquid traveling along the nozzle surface 1*a* from entering the gas chamber 81 from the air communication channel 82.

Figure 13:
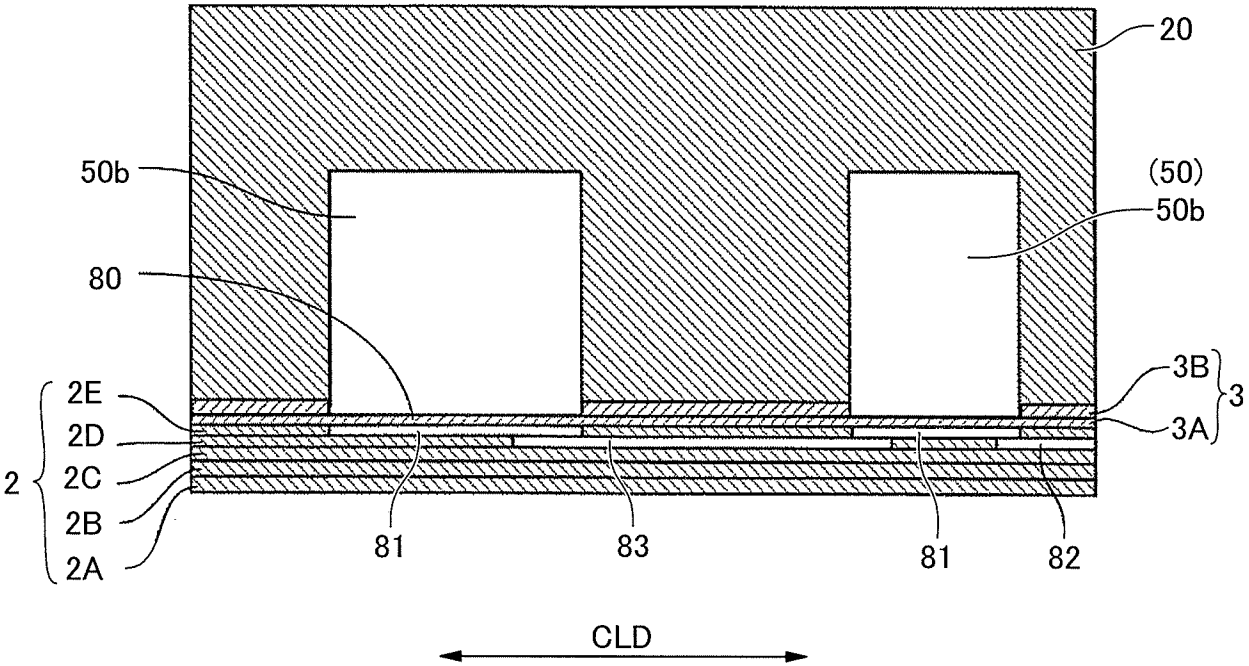
FIG. 13 is a cross-sectional side view of the head in the chamber length direction perpendicular to the nozzle array direction according to the fourth embodiment of the present disclosure.
Figure 14A:
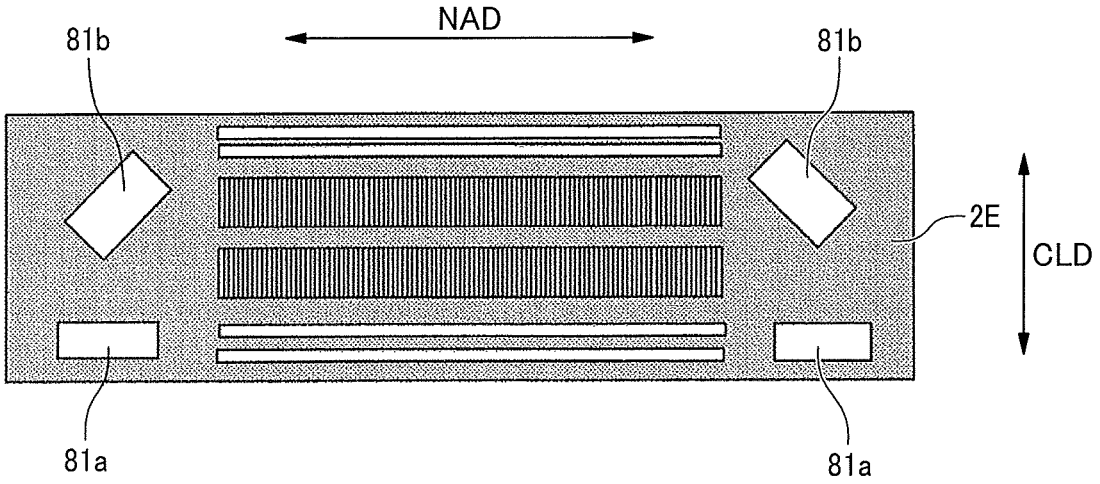
FIGS. 14A and 14B are plan views of plates constituting the channel plate of the head according to the fourth embodiment.
Figure 14B:
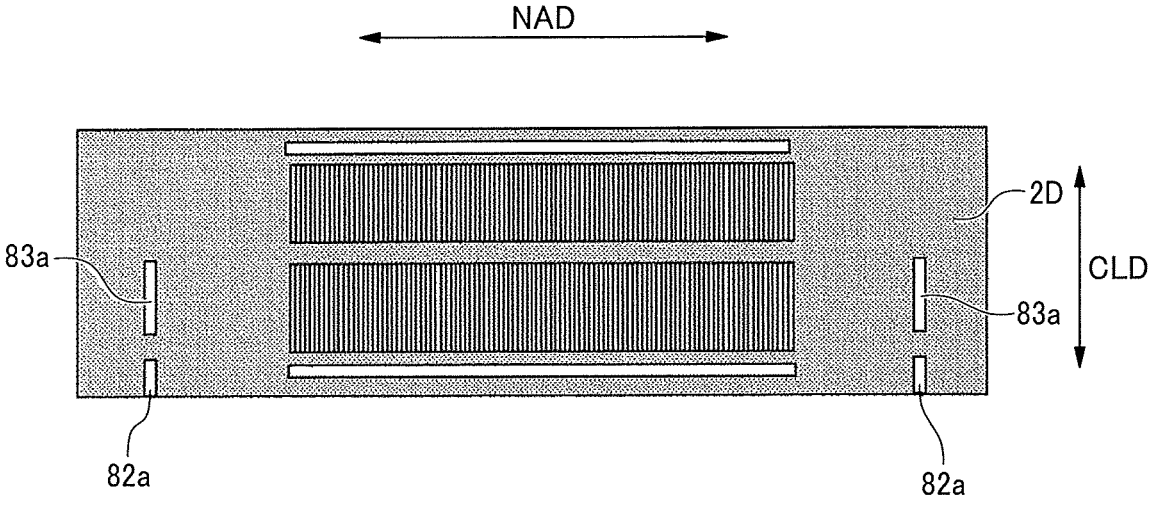

A fourth embodiment of the present disclosure is described with reference to FIG. 13 and FIGS. 14A and 14B. FIG. 13 is a cross-sectional side view of the head 100 along the chamber length direction CLD perpendicular to the nozzle array direction NAD. FIGS. 14A and 14B are plan views of plates 2E and 2D constituting a channel plate 2 of the head 100 according to the third embodiment.

The head 100 in the fourth embodiment includes a gas chamber 81 in the channel plate 2 as the channel member, a bridging channel 83 that connects a plurality (here, two) of gas chambers 81 arranged in the chamber length direction CLD in the channel plate 2 with each other, and an air communication channel 82 that connects one of the plurality of gas chambers 81 with the atmosphere.

Here, both the bridging channel 83 and the air communication channel 82 are formed along an in-plane direction of the channel plate 2, and the air communication channel 82 opens at one end in the chamber length direction CLD (perpendicular to the nozzle array direction NAD) of the channel plate 2.

Specifically, the gas chamber 81 of the head 100 includes through holes 81*a* and 81*b* in a plate 2E that contacts the diaphragm 3. The bridging channel 83 includes two through grooves 83*a* each connects the through holes 81*a* and 81*b* in the chamber length direction CLD of the channel plate 2 in the plate 2D.

The through groove 83*a* is arranged at vicinity of each ends of the plate 2D outside the plurality of pressure chambers 6 arrayed in the nozzle array direction NDA. The through holes 81*a* and 81*b* are also arranged at vicinity of each ends of the plate 2D outside the plurality of pressure chambers 6 arrayed in the nozzle array direction NDA. Thus, each of the through grooves 83*a* connects the through holes 81*a* and 81*b* arranged at vicinity of each ends of the plate 2D in the nozzle array direction NAD.

Further, the head 100 includes the through grooves 82*a* that communicates with the through holes 81*a*, respectively, and open at one end (lower end in FIG. 14B) of the channel plate 2 in the chamber length direction CLD in the plate 2D.

As described above, the head 100 includes a plurality of gas chambers 81 communicating with each other in the channel member (channel plate 2). Thus, the head 100 according to the fourth embodiment can reduce a number of air communication channel 82 that opens at one end of the channel member (channel plate 2) and prevent the liquid traveling along the nozzle surface from entering the gas chamber 81 from the air communication channel 82.

Figure 15:
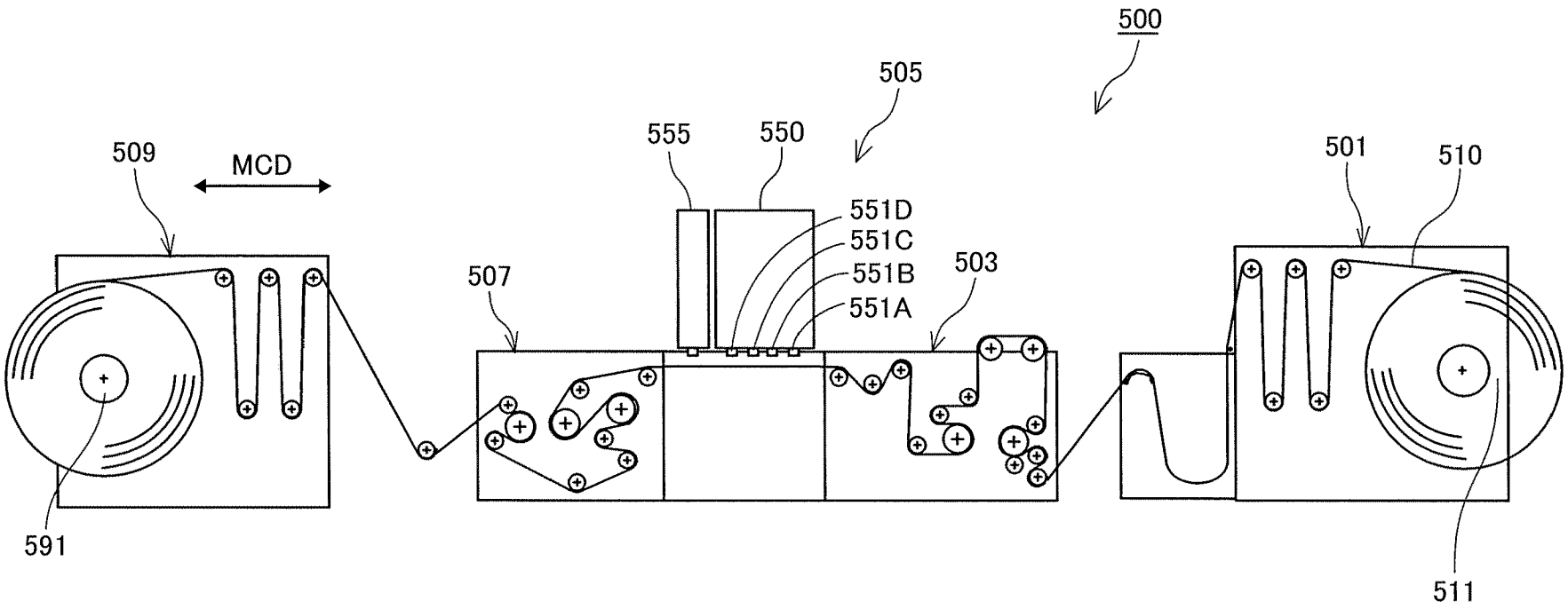
FIG. 15 is a schematic side view of a liquid discharge apparatus according to the present disclosure.
Figure 16:
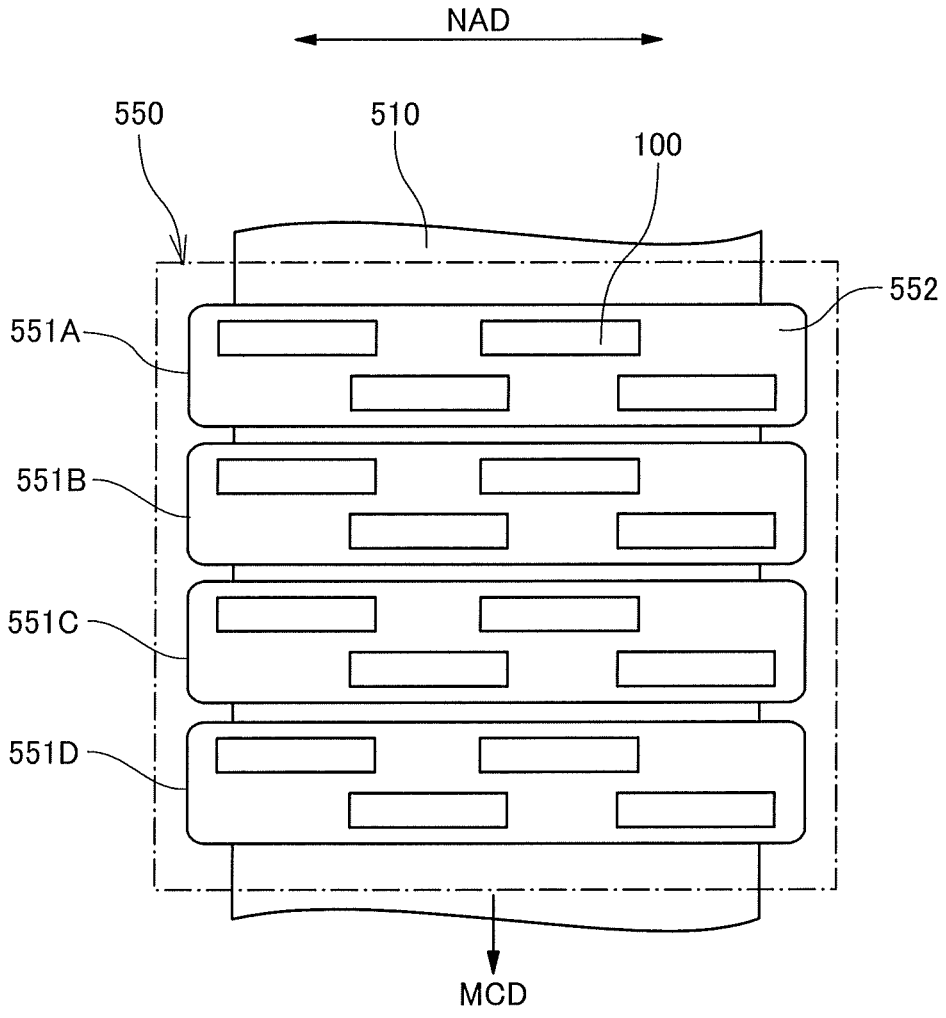
FIG. 16 is a plan view of a head unit of the liquid discharge apparatus of FIG. 15.

Next, an example of the liquid discharge apparatus 500 according to the present disclosure is described with reference to FIGS. 15 and 16. FIG. 15 is a side view of the liquid discharge apparatus 500 according to the present disclosure. FIG. 16 is a plan view of a head unit 550 of the liquid discharge apparatus 500 of FIG. 15 according to the present disclosure.

The liquid discharge apparatus 500 according to the present disclosure includes a feeder 501 to feed a continuous medium 510, a guide conveyor 503 to guide and convey the continuous medium 510 fed from the feeder 501 to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the drier unit 507, and wound around a take-up roller 591 of the ejector 509.

In the printing unit 505, the continuous medium 510 is conveyed so as to face the head unit 550 and the head unit 555. The head unit 550 discharges the liquid (ink) onto the continuous medium 510 to form an image on the continuous medium 510. The head unit 555 discharges a treatment liquid onto the continuous medium 510 to perform post-treatment on the continuous medium 510 with the treatment liquid.

The head unit 550 includes, for example, four-color full-line head arrays 551A, 551B, 551C, and 551D (hereinafter, collectively referred to as "head arrays 551" unless colors are distinguished) from an upstream side in a direction of conveyance of the continuous medium 510 (hereinafter, "medium conveyance direction") indicated by arrow MCD in FIG. 2.

Each of the head arrays 551 is a liquid discharge device to discharge liquid of black (K), cyan (C), magenta (M), and yellow (Y) onto the continuous medium 510 conveyed along the medium conveyance direction MCD. Note that the number and types of color are not limited to the above-described four colors of K, C, M, and Y and may be any other suitable number and types.

In each head arrays 551, for example, as illustrated in FIG. 16, the heads 100 according to the present disclosure are staggered on a base 552 to form the head arrays 551. Note that the configuration of the head arrays 551 are not limited to such a configuration.

Figure 17:
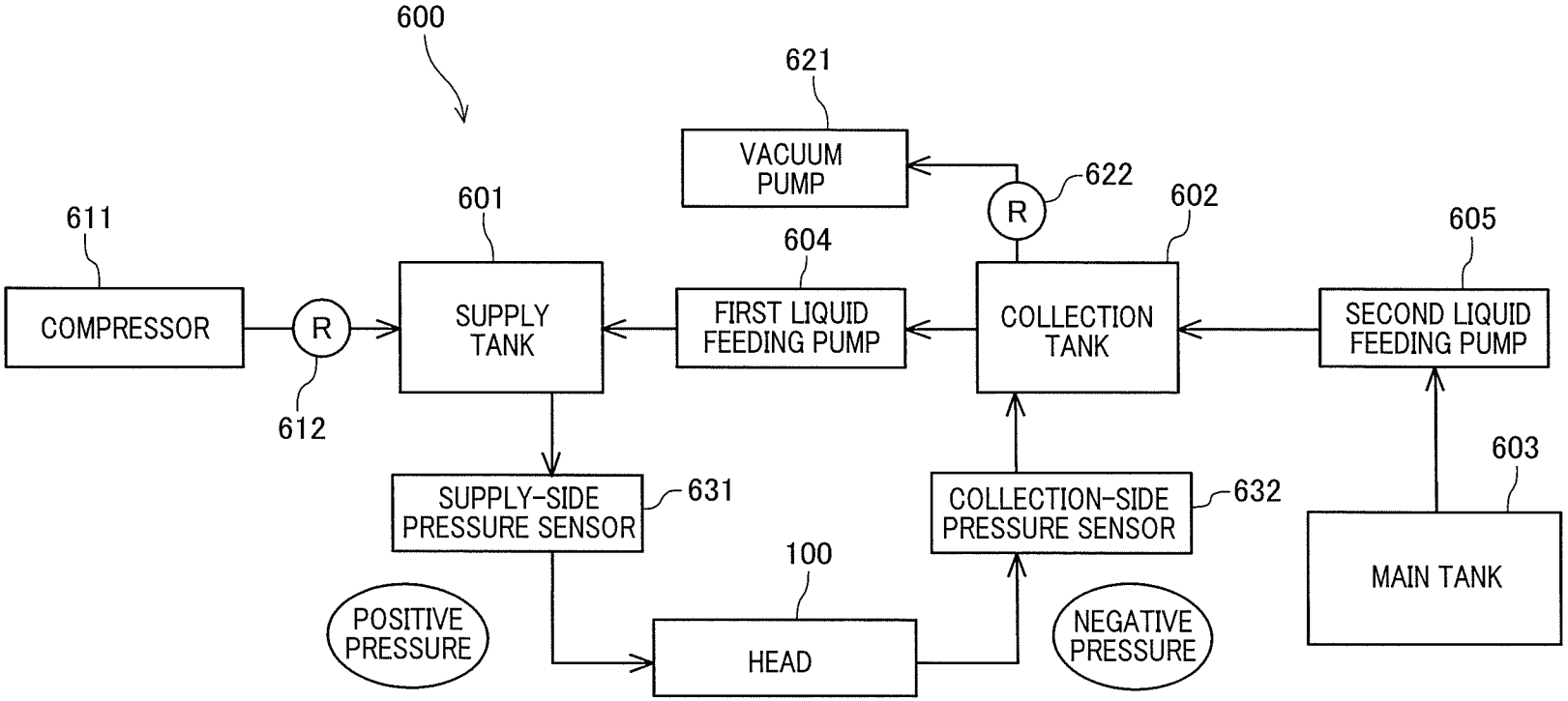
FIG. 17 is a circuit diagram illustrating an example of a liquid circulation device according to the present disclosure.

Next, following describes an example of a liquid circulation device 600 employed in a liquid discharge apparatus according to the present disclosure with reference to FIG. 17.

FIG. 17 is a circuit diagram illustrating a structure of the liquid circulation device 600. Although only one head 100 is illustrated in FIG. 17, in the structure including a plurality of heads 100 as illustrated in FIGS. 1 to 14, supply channels and collection channels are respectively coupled via manifolds or the like to the supply-sides and collection-sides of the plurality of heads 100.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, and a supply-side pressure sensor 631, and a collection-side pressure sensor 632.

The compressor 611 and the vacuum pump 621 together generate a difference between the pressure in the supply tank 601 and the pressure in the collection tank 602.

The supply-side pressure sensor 631 is connected between the supply tank 601 and the head 100 and connected to the supply channels connected to the supply port 71 of the head 100. The collection-side pressure sensor 632 is connected between the head 100 and the collection tank 602 and is connected to the collection channels connected to the collection port 72 of the head 100.

One end of the collection tank 602 is coupled to the supply tank 601 via the first liquid feed pump 604, and the other end of the collection tank 602 is coupled to the main tank 603 via the second liquid feed pump 605.

Accordingly, the liquid flows from the supply tank 601 into the head 100 via the supply port 71 and exits the head 100 from the collection port 72 into the collection tank 602. Further, the first liquid feed pump 604 feeds the liquid from the collection tank 602 to the supply tank 601, thus circulating liquid.

Here, a compressor 611 is connected to the supply tank 601 and is controlled so that a predetermined positive pressure is detected by the supply-side pressure sensor 631. Conversely, a vacuum pump 621 is connected to the collection tank 602 and is controlled so that a predetermined negative pressure is detected by the collection-side pressure sensor 632.

Such a configuration allows the menisci of ink to be maintained at a constant negative pressure while circulating liquid through the inside of the head 100.

When droplets are discharged from the nozzles 4 of the head 100, the amount of liquid in each of the supply tank 601 and the collection tank 602 decreases. Accordingly, the collection tank 602 is replenished with the liquid fed from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

Next, another example of a printing apparatus as a liquid discharge apparatus 500 according to the present disclosure is described with reference to FIGS. 18 and 19.

Figure 18:
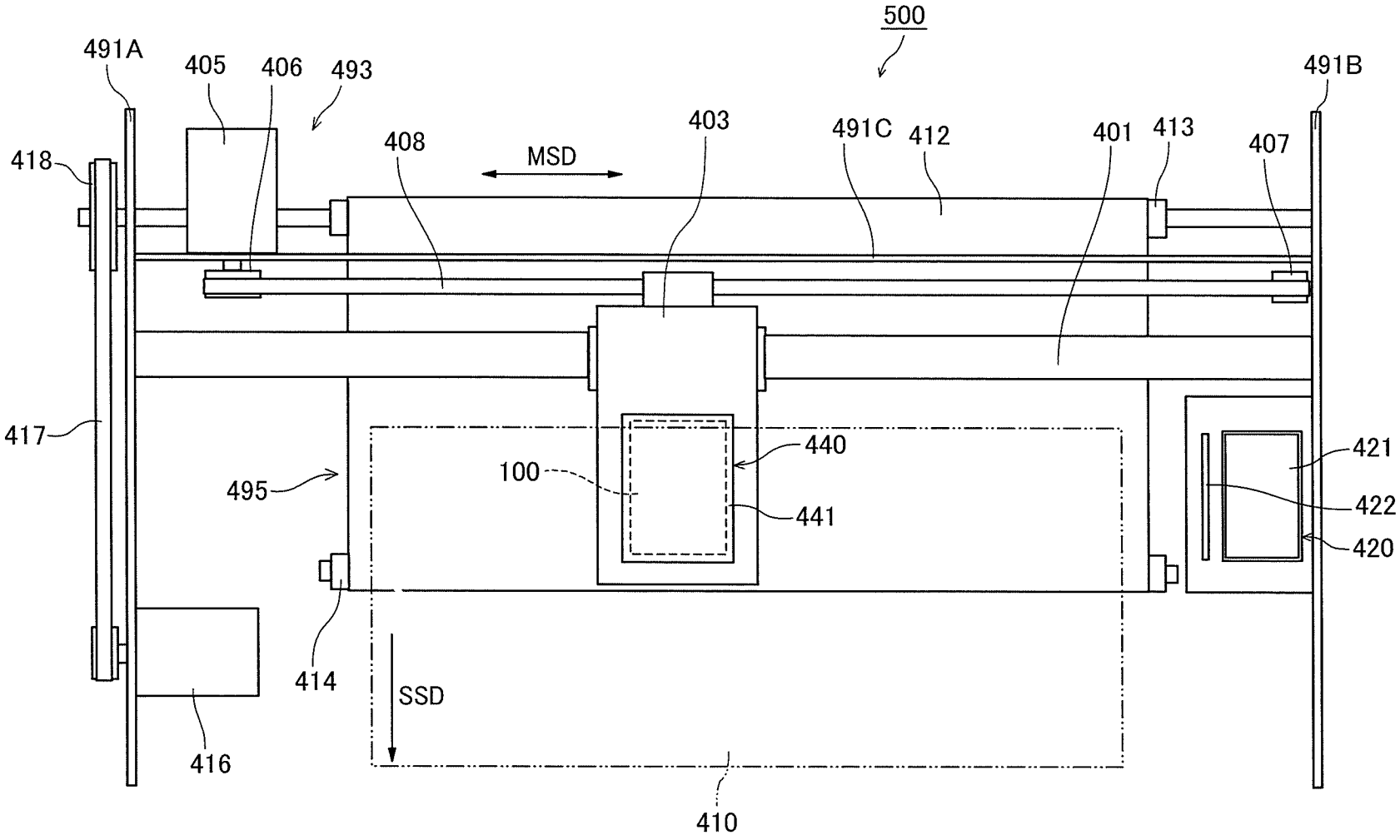
FIG. 18 is a plan view of a portion of a liquid discharge apparatus according to an embodiment of the present disclosure.

FIG. 18 is a plan view of a portion of the printing apparatus (liquid discharge apparatus 500).

Figure 19:
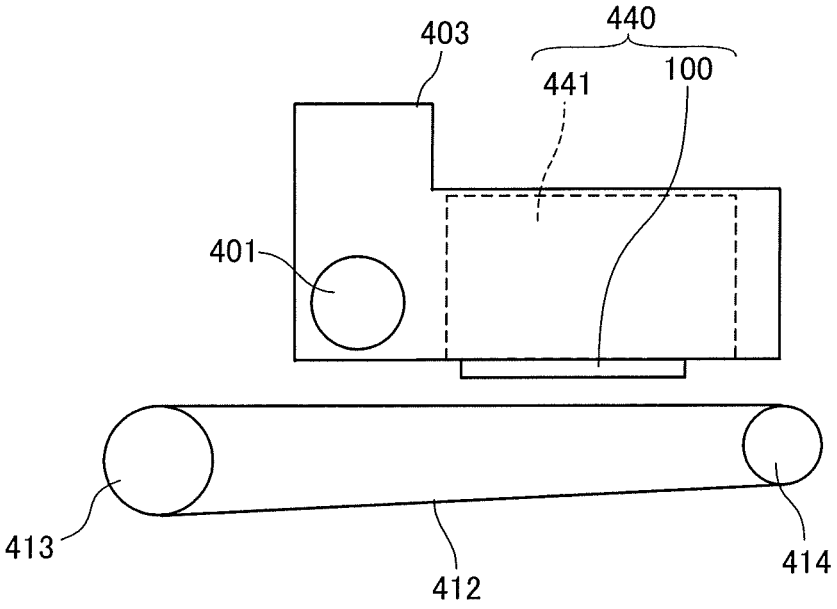
FIG. 19 is a schematic side view of a main portion of the liquid discharge apparatus.

FIG. 19 is a side view of a portion of the printing apparatus (liquid discharge apparatus 500) of FIG. 18.

The printing apparatus (liquid discharge apparatus 500) is a serial type apparatus, and the carriage 403 is reciprocally moved in the main scanning direction MSD by the main scan moving unit 493. The main scan moving unit 93 includes a guide member 401, a main scanning motor 405, a timing belt 408, and the like.

The guide member 401 is bridged between a left side plate 491A and a right-side plate 491B and holds the carriage 403 so as to be movable in the main scanning direction MSD. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 100 according to the present disclosure and a head tank 441 forms the liquid discharge device 440 as a single unit. The head 100 of the liquid discharge device 440 discharges liquid of each color, for example, yellow (Y), cyan (C), magenta (M), and black (K).

Figure 20:
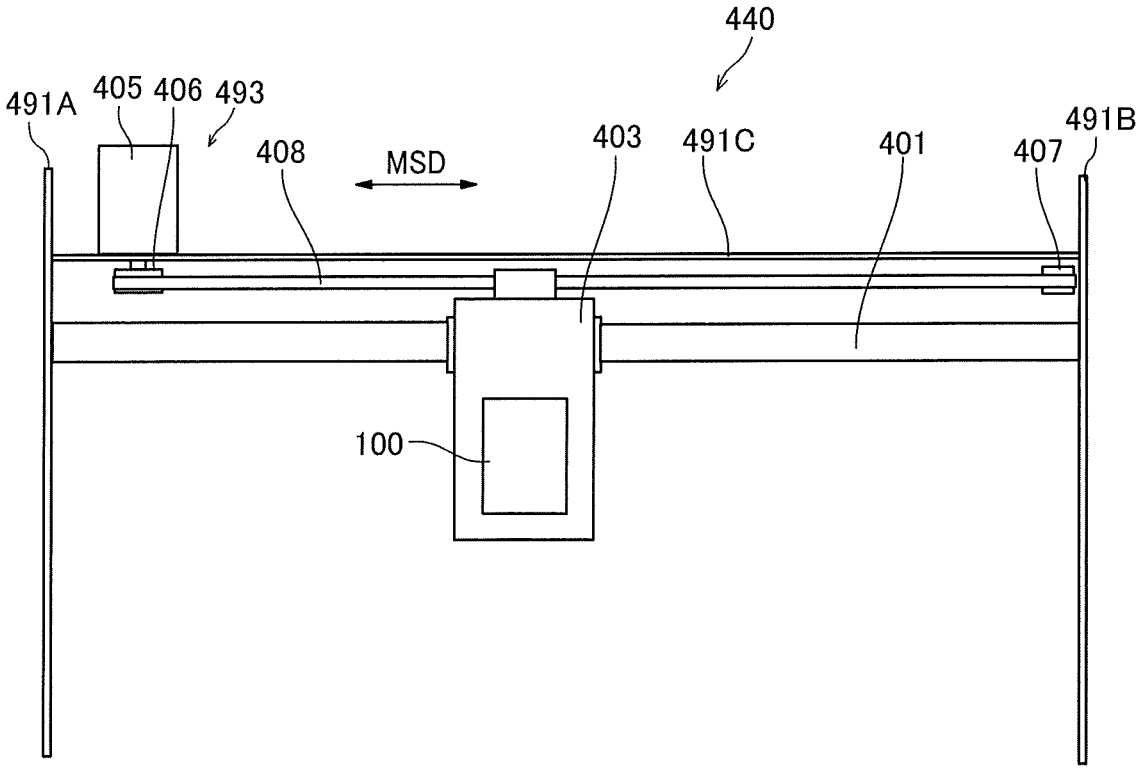
FIG. 20 is a plan view of the main portion of another example of the liquid discharge device.

The head 100 includes a nozzle array including a plurality of nozzles arrayed in row in a sub-scanning direction SSD perpendicular to the main scanning direction indicated by arrow MSD in FIG. 20. The head 100 is mounted to the carriage 403 so that ink droplets are discharged downward.

The head 100 is connected to the liquid circulation device 600 described above, and a liquid of a required color is circulated and supplied.

The printing apparatus (liquid discharge apparatus 500) includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 100. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance belt 412 rotates in the sub-scanning direction as indicated by arrow SSD as the conveyance roller 413 is rotationally driven by the sub-scanning motor 416 via the timing belt 417 and the timing pulley 418.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap the nozzle surface 1*a* (surface on which the nozzle 4 is formed) of the head 100, a wiper 422 to wipe the nozzle surface 1*a*, and the like.

The main scan moving unit 493, the maintenance unit 420, and the conveyor 495 are mounted to a housing that includes the left side plate 491A, the right-side plate 491B, and a rear side plate 491C.

In the printing apparatus (liquid discharge apparatus 500) thus configured, the sheet 410 is conveyed on and attracted to the conveyance belt 412 and is conveyed in the sub-scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Next, the liquid discharge device 440 according to another embodiment of the present disclosure is described with reference to FIG. 20. FIG. 20 is a plan view of a portion of another example of the liquid discharge device 440.

The liquid discharge device 440 includes a housing, the main scan moving unit 493, the carriage 403, and the head 100 among components of the printing apparatus (liquid discharge apparatus 500). The left side plate 491A, the right-side plate 491B, and the rear side plate 491C constitute the housing.

Note that, in the liquid discharge device 440, the maintenance unit 420 described above may be mounted on, for example, the right-side plate 491B.

Figure 21:
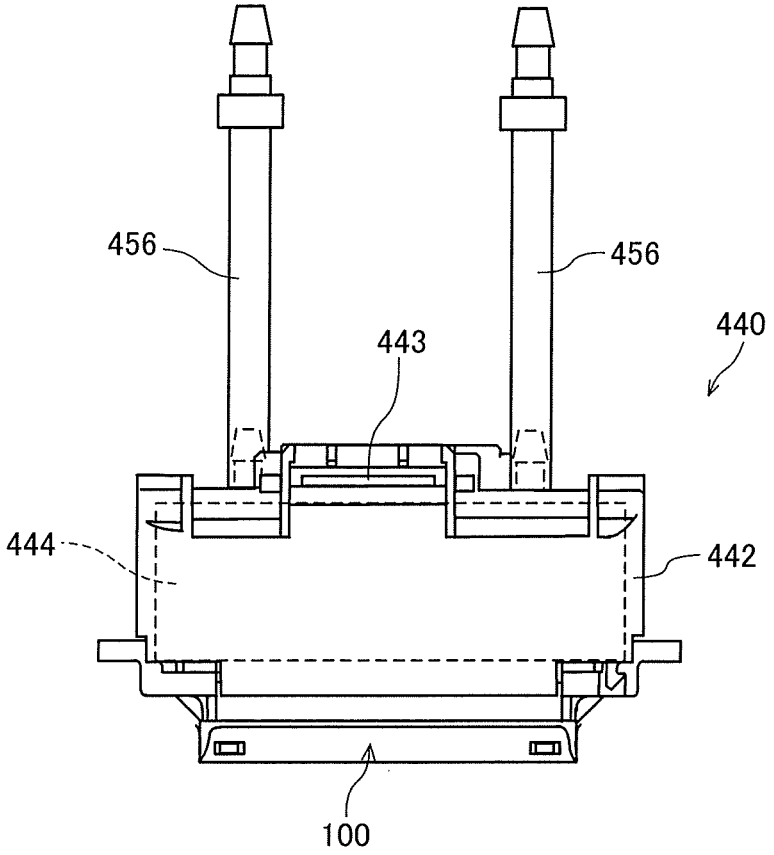
FIG. 21 is a front view of the liquid discharge device according to still another embodiment of the present disclosure.

Next, still another example of the liquid discharge device 440 according to the present disclosure is described with reference to FIG. 21. FIG. 21 is a front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. Instead of the channel part 444, the liquid discharge device 440 may include the head tank 441. A connector 443 electrically connected with the head 100 is provided on an upper part of the channel part 444.

In the present disclosure, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit.

For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another.

The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head tank or the channel member mounted on the head so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell.

The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles from which a liquid is discharged in a liquid discharge direction, the plurality of nozzles being arrayed in a nozzle array direction;

a plurality of pressure chambers communicating with the plurality of nozzles, respectively, the plurality of pressure chambers arrayed in the nozzle array direction;

a plurality of collection-side individual channels overlapping with the plurality of pressure chambers in the liquid discharge direction, the plurality of collection side individual channels communicating with the plurality of pressure chambers, respectively, a common supply channel communicating with each of the plurality of pressure chambers;

a common collection channel communicating with each of the plurality of collection-side individual chambers; and a damper disposed at both ends of the common collection channel in the nozzle array direction outside an array of the plurality of pressure chambers in the nozzle array direction, and configured to form an inner surface of the common collection channel.

2. The liquid discharge head according to claim 1, further comprising:

a plate configured to form a portion of the inner surface of the common supply channel and the common collection channel, wherein the plate includes a first portion and a second portion having a higher rigidity than the first portion, and the first portion forms the damper.

3. The liquid discharge head according to claim 2,
wherein the first portion is a thin portion,
the second portion is a thick portion having a thickness thicker than the thin portion, and
the thin portion forms the damper.

4. The liquid discharge head according to claim 2, wherein the plate includes a diaphragm configured to deform to apply pressure on the plurality of pressure chambers.

5. The liquid discharge head according to claim 1, wherein a width of a portion of the common supply channel that faces the damper is wider than a width of another portion of the common supply channel connected with the plurality of pressure chambers.

6. The liquid discharge head according to claim 1, further comprising: a gas chamber disposed opposite to the common supply channel across the damper.

7. The liquid discharge head according to claim 1, wherein a width of a portion of the common collection channel that faces the damper is wider than a width of another portion of the common collection channel connected with the plurality of pressure chambers.

8. The liquid discharge head according to claim 7, further comprising:
a gas chamber disposed opposite to the common collection channel across the damper.

9. The liquid discharge head according to claim 6, wherein the gas chamber is connected to an air communication channel communicating with atmosphere.

10. The liquid discharge head according to claim 9, further comprising:
a channel member configured to form the plurality of pressure chambers,
wherein the channel member includes:
a first layer forming the gas chamber, and
a second layer forming the air communication channel.

11. The liquid discharge head according to claim 10,
wherein the air communication channel is arranged along a surface of the channel member, and
the air communication channel opens to an end of the channel member in another direction perpendicular to the one direction.

12. The liquid discharge head according to claim 11, further comprising:
a plurality of gas chambers including the gas chamber arranged in the another direction; and
a bridging channel connecting the plurality of gas chambers,
wherein the air communication channel is connected to a part of the plurality of gas chambers.

13. A liquid discharge device comprising the liquid discharge head according to claim 1.

14. The liquid discharge device according to claim 13, wherein the liquid discharge head is integrated with at least one of:
a head tank configured to store the liquid to be supplied to the liquid discharge head,
a carriage on which the liquid discharge head is mounted,
a supply unit configured to supply the liquid to the liquid discharge head,
a recovery device configured to maintain the liquid discharge head, and
a main scan moving unit configured to move the liquid discharge head in a main scanning direction.

15. A liquid discharge apparatus comprising the liquid discharge device according to claim 13.

16. A liquid discharge head, comprising:
a plurality of nozzles from which a liquid is discharged in a liquid discharge direction, the plurality of nozzles arrayed in a nozzle array direction;
a plurality of pressure chambers communicating with the plurality of nozzles, respectively, the plurality of pressure chambers arrayed in the nozzle array direction;
a plurality of collection-side individual channels overlapping with the plurality of pressure chambers in the liquid discharge direction, the plurality of collection side individual channels communicating with the plurality of pressure chambers, respectively,
a common supply channel communicating with each of the plurality of pressure chambers;
a common collection channel communicating with each of the plurality of collection-side individual charnels; and
a damper disposed at both each ends of the common supply channel in the nozzle array, direction outside an array of the plurality of pressure chambers in the nozzle array direction, and configured to form an inner surface of the common supply channel.

* * * * *